US009789997B2

(12) United States Patent
Eble

(10) Patent No.: US 9,789,997 B2
(45) Date of Patent: Oct. 17, 2017

(54) STACKABLE CONTAINER

(75) Inventor: Raymond C. Eble, Sugaloaf, PA (US)

(73) Assignee: Pretium Packaging, L.L.C., Chesterfield, MO (US)

( * ) Notice: Subject to any disclaimer, the term of this patent is extended or adjusted under 35 U.S.C. 154(b) by 806 days.

(21) Appl. No.: 13/087,883

(22) Filed: Apr. 15, 2011

(65) Prior Publication Data

US 2012/0261297 A1 Oct. 18, 2012

(51) Int. Cl.

| | |
|---|---|
| ***A47G 19/00*** | (2006.01) |
| ***B65D 21/02*** | (2006.01) |
| ***B65D 6/28*** | (2006.01) |
| ***B65D 8/04*** | (2006.01) |
| ***B65D 8/06*** | (2006.01) |
| ***B65D 21/00*** | (2006.01) |
| ***B65D 85/62*** | (2006.01) |
| ***B65D 19/36*** | (2006.01) |

(52) U.S. Cl.
CPC ..... *B65D 21/0231* (2013.01)

(58) Field of Classification Search
CPC B65D 21/02; B65D 21/0209; B65D 21/0212; B65D 21/0213; B65D 21/0215; B65D 19/38; B65D 21/023; B65D 21/0231; B65D 2571/00012; B65D 2571/00067
USPC ..... 220/23.6, 23.83, 606; 206/509; 215/10
See application file for complete search history.

(56) References Cited

U.S. PATENT DOCUMENTS

| | | | | |
|---|---|---|---|---|
| 237,168 | A | 2/1881 | Carpenter | |
| 2,641,374 | A * | 6/1953 | Der Yuen | 215/10 |
| 3,474,843 | A * | 10/1969 | Maris | 206/599 |
| 5,119,972 | A * | 6/1992 | Reed et al. | 222/143 |
| 5,318,787 | A * | 6/1994 | Brauner et al. | 426/120 |
| 2006/0260971 | A1 * | 11/2006 | Rivera et al. | 206/509 |

* cited by examiner

*Primary Examiner* — Andrew T Kirsch
(74) *Attorney, Agent, or Firm* — Armstrong Teasdale LLP

(57) ABSTRACT

A container which includes a recessed portion and a complimentary top and base of generally undulating design which allow for a stack of such containers to be arranged where the neck of a lower container is placed within the recessed portion of an upper container and the base of the upper container contacts the top of the lower container. The container stack can then be extended to comprise multiple stacks which are positioned on a shipping pallet to provide for improved transportation efficiency of palletized containers.

11 Claims, 9 Drawing Sheets

STACKABLE CONTAINER

BACKGROUND

1. Field of the Invention

This disclosure relates to the field of containers, particularly to plastic containers which are designed to be stacked and which can formed a "squared" load when palletized.

2. Description of the Related Art

Containers are ubiquitous for the sale of goods in society. The sale of many products is essentially impossible without containers in which to transport the products. While the concept of bulk products (where a user supplies their own container which is filled from a larger container or a processing machine) is popular for some items due to the end consumer's ability to save money on the product by not having to pay for the container it is packed in and the ability of producers to ship products less expensively, most items in today's society are prepackaged in disposable containers prior to sale. In this way, a consumer can simply grab a single container of product for easy transport, purchase, and storage. It also provides the product in a fixed, generally popular, size.

While the container in which items are sold is often of relatively little import to the end consumer (other than for selecting a size), the design of a container can have a large effect on the manufacture, transport, and storage of the product within it. For a manufacturer, performance of the container under certain conditions allows for the product to be provided to the consumer easier or less expensively which can have a dramatic effect on both profitability of the manufacturer and resultant retail price of the product which can improve sales. Improving the container can therefore result in increases to the manufacturers' profitability.

In the first instance, a manufacturer cares about the weight of a container. While heavier containers such as rigid glass containers are generally seen as being stronger and more resilient, heavier containers cost more to construct, as they require more raw ingredients, and, due to the increased weight, also cost more to transport both from the packaging manufacturer to the packaging plant, and (once filled) to the end consumers. This creates increased fuel cost, as well as potentially decreasing the maximum load that can be placed in a truck further increasing logistics costs. Glass containers are also relatively easy to break resulting in increased spoilage.

Today's society is also placing an increased value on conservation. Therefore, containers are in demand which conserve raw materials by using less material in their construction to save on manufacturing costs, that conserve fuel by improving transportation efficiency, that preserve natural resources, and which do not require wasteful consumed products to be used in their transport. Interest in the cost of transportation has significantly increased recently due to recognition that even the most efficient production practices can be foiled by significant transportation losses. Further, it is desired that containers be relatively easily recycled to make new containers. For all these reasons, containers are striving to get lighter and stronger using less material to make containers that still can meet performance necessities for shipping, while allowing for increases in shipping efficiencies.

Because of the various competing desires in packaging, a large number of products are changing from being packaged in glass or metal to being packaged in plastics. Plastics are generally lighter than alternatives, often more resilient, and can be recycled. There are also a wide variety of plastics available which can be selected depending on the products sold in the container. The most common type of plastic containers are probably polyethylene terephthalate (PET) containers which can be blow-molded and can provide for a clear finish which resembles glass.

Plastic containers, are usually significantly thinner than similar glass containers and recent improvements in technology have allowed them to become even thinner while still retaining resilience. The material forming the container neck, however, where a screw top or similar lid joins to the container, is often quite a bit thicker than the material forming the rest of the container. Some of this thickness is to supply strength to the top to resist the torque or other force applied when the lid is screwed on or off, however some of the structure is to be able to support the containers in stacks.

It is well established that it is almost always less expensive to store products in taller vertical space than over more horizontal space. Thus, the ability to stack containers is very important and in most storage scenarios there are always a number of containers of the same size and shape stacked on top of each other. Stacking of containers, however, is often much more complicated than it may seem. Most containers provide for an extended neck which is taller than the main body of the container structure. This neck allows for a lid to easily be screwed, snapped, connected or otherwise positioned on and off. At the same time, however, when containers are stacked, generally a higher container will rest on the lower containers lid or neck due to this vertical extension. When this happens, the weight of that upper container is only distributed across the containers lid (or the rim of the neck if the container is empty) and therefore the shoulder between the neck and the top surface of the container bears significant weight from the stack.

In some cases, the neck is simply unable to bear the necessary weight. In narrow necked containers, the lid or rim may be so small when compared to the base of the upper container that the stack is unstable. Thus, stacking of these types of containers is generally not possible unless there is a cardboard or other sheet placed between the rims of a number of containers in a layer and the bases of the layer above to distribute the force. These type of containers are often, therefore, distributed in packing boxes which only hold a single layer of containers, but can themselves be stacked, or with sheets of cardboard or another segregating material between the layers of the stack to provide for force distribution.

Even in container designs with wider necks, segregating sheets between layers of the stack are often still necessary to prevent the mass of the above containers from being focused too narrowly on the shoulder of the lower container. Thus, when containers have traditionally been stacked for storage or transport, the containers are positioned to form a first layer. This first layer then has a piece of segregation material placed on it (usually a cardboard sheet), and a second layer is placed on the segregation layer. The process is repeated until a desired stack height is obtained. Stacks in these arrangements could result in containers at the second layer being positioned directly over containers in the first layer, or could result in offsets to further distribute force.

While this form of transport is effective, it tends to result in the production of a lot of excess packing material which is discarded by the end user of the containers. The problem exists at two different points. The problem exists first when empty containers are stacked and shipped from the packaging manufacturing plant to the plant where they are to be filled. The problem exists again when the containers a filled and shipped to end retailers. Thus, there is a possibility that the segregation sheets are created and discarded twice for the same load of containers.

Another problem with the transport of empty containers for later filling is that they generally do not have their lids on. Instead, the lids are shipped separately so they do not have to be removed to fill the containers. The lid can serve to better distribute weight across the neck and therefore can provide for some additional strength. Empty containers can, therefore, have greater stacking issues than filled containers, even though the total weight is less. A lid can also provide increased rigidity to the neck simply by having its additional structure on the side of the neck which can add as a structural reinforcement.

Another issue related to the transportation and storage of containers is that they generally need to be palletized in order to be moved efficiently. Most containers are created based solely on the desired resultant size and container look and therefore do not take into account how to be best palletized in order to improve transportation efficiency. Because of this, the containers generally do not occupy a large percentage of the volume in the space above the pallet. This is particularly true of rounded containers but is true even with many squared containers. Basically, the container takes up a greater volume of the space available above the pallet than that which is within its interior volume (its useful space).

This wasted space includes the space around the container's neck, above its top surface, and below the next base (or more particularly the segregation sheet) as well as space between the container and the next on the same level, and the space between the edge of containers and the edge of a pallet. All of this wasted space is effectively shipped instead of extra containers. Thus, the cost to transport each container is increased when containers do not effectively utilize the volume of available space positioned above a shipping pallet.

SUMMARY

Because of these and other problems in the art, discussed herein are plastic containers which include a variety of features that allow them to be stacked higher without need for force distributing segregation panels to be placed between layers of containers or for the containers to be placed in shipping boxes. The containers described herein can also be specifically sized and shaped to maximize the number of containers that can fit on a standard pallet during shipping, to provide stack strength without need for segregation panels, and to inhibit relative movement between neighboring containers.

Described herein, among other things, is a container comprising: a base; a top; a main body extending generally vertically from a distal end connected to said base to a proximal end connected to said top; a neck, said neck being positioned in said top to allow access into an internal volume of said container; and a recessed portion, said recessed portion being positioned in said base; wherein each of said top and said base comprise corresponding surfaces, such that when said neck of a first container is placed in said recessed portion of a second container, said base of said second container is in contact with the said top of said first container at a plurality of discrete surface areas.

In an embodiment of the container, the neck is cylindrical having an outer surface and a top rim. The neck may includes an external screw thread arranged to surround said neck, the recessed portion of said second container.

In an embodiment the recessed portion of said second container, when said first container and said second container are in contact at said plurality of discrete areas, does not contact said rim and/or said screw threads of said first container.

In an embodiment of the container the container is generally rectangular in horizontal cross section, said main body having four major surfaces. The top and said base may be undulating where the crests of the undulations are arranged generally in the center of said major surfaces and the troughs of said undulations are arranged generally at the corners where said major surfaces connect to each other.

In an embodiment, the container comprises four minor surfaces, each of said minor surfaces being connected to two of said major surfaces and each of said major surfaces being connected to two of said minor surfaces. Crests of said undulation are arranged generally in the center of said major surfaces and troughs of said undulations are arranged generally at the centers of said minor surfaces. The troughs of said base may be generally flat surfaces wherein when two of said containers are placed on top of each other, said crests on said base of a first container contact said crests on said top of said second container and said discrete surfaces are arranged about said crests.

In an embodiment the container further comprises a lid placed on said neck of said container. The recessed portion of said second container, when said first container and said second container are in contact at said plurality of discrete areas, contacting a top and/or side of said lid.

There is also described herein, a pallet of containers comprising: a plurality of containers, each of said containers comprising: a base; a top; a main body extending generally vertically from a distal end connected to said base to a proximal end connected to said top; a neck, said neck being positioned in said top to allow access into the internal volume of said container; and a recessed portion, said recessed portion being positioned in said base; wherein each of said top and said base comprise corresponding surfaces, such that when said neck of a first container is placed in said recessed portion of a second container, said base of said second container is in contact with the said top of said first container at a plurality of discrete surface areas; a pallet having a surface area; and a cover sheet; wherein said plurality of containers are arranged in a plurality of stacks, each of said stacks including at least two of said containers; wherein said stacks are positioned on said surface area; and wherein said cover sheet is positioned on said stacks.

In an embodiment of the pallet, the stacks are positioned above substantially all of said surface area.

There is also described herein a container comprising: a base; a top; a main body extending generally vertically from a distal end connected to said base to a proximal end connected to said top; a neck, said neck being positioned in said top to allow access into an internal volume of said container; and a recessed portion, said recessed portion being positioned in said base; wherein each of said top and said base comprise complimentary undulating surfaces.

DESCRIPTION OF PREFERRED EMBODIMENT(S)

Figure 1:
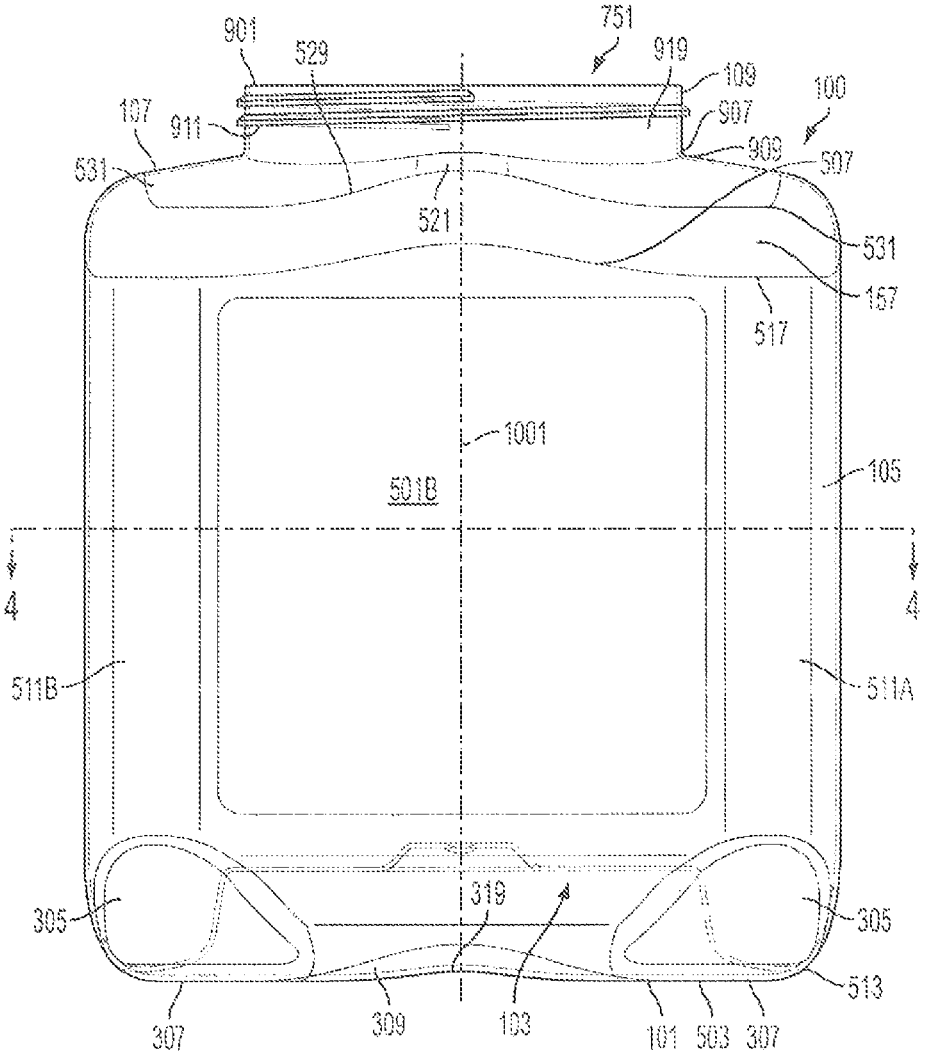
FIG. 1 provides a side view of an embodiment of a container. This embodiment is depicted as formed of translucent material to make internal structure visible.
Figure 2:
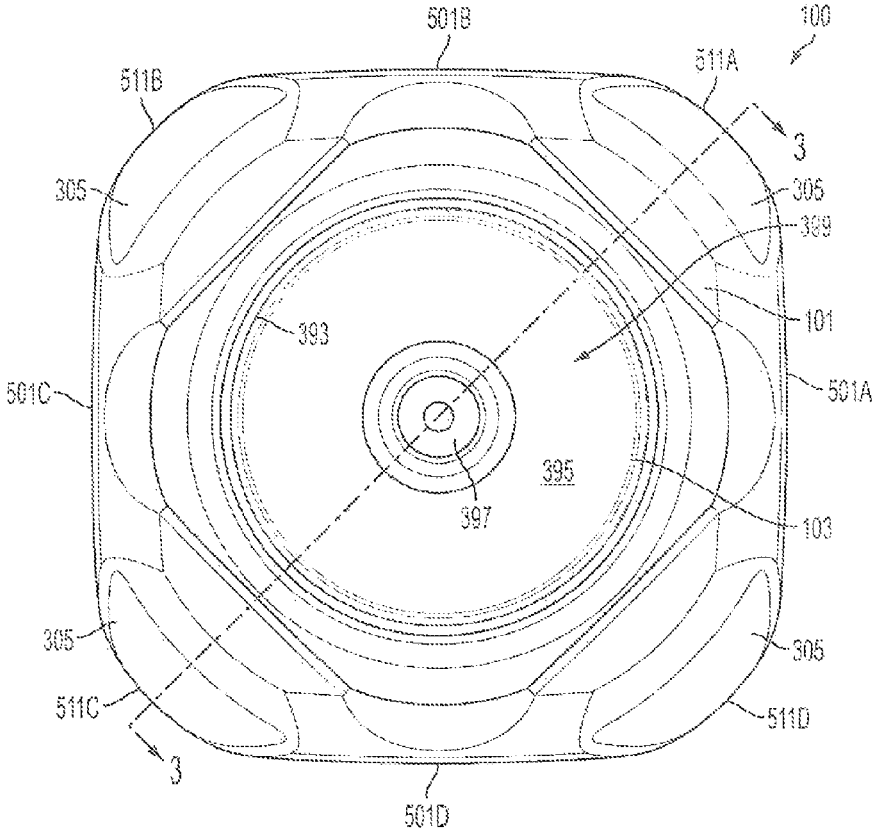
FIG. 2 provides a bottom view of the container of FIG. 1.

FIGS. 1-4 provide for various views of an embodiment of a container (100). The container is a general container having a relatively wide-mouth which is designed to hold a variety of goods including bulk solids (such as powders or prepared solid foods (e.g. pretzels or cookies)), liquids, and solids in liquid. In the embodiment of FIGS. 1-4, the container (100) is generally considered a "square" container as it can be considered to have four major surfaces (501A), (501B), (501C) and (501D) and is generally square in cross section. As can be see from FIGS. 2 and 4, however, the cross section of the container (100) is not actually square but has had the corners rounded and flattened so as to produce a generally hexagonal cross section.

For ease of production by plastic molding techniques, it should be recognized that the container (100) will generally not include sharp corners or bends but the general components will instead smoothly flow into each other via rounded connections. While this is not required, it generally improves ease of manufacture. This disclosure, however, will often times refer to shapes (such as squares) that have sharp corners. This is done purely for ease of understanding and nothing in this disclosure should be taken as a requirement that the container include perfectly flat, linear, or angled components in its construction. All components may include some smooth bend without altering the basic shapes discussed.

The container (100) can be considered to have generally five major construction components. These include the base (101), which includes a recessed portion (103) therein. The base (101) should be considered to be the portion of the container (100) on which it will generally rest so that the top (107) is arranged above the base (101) when the container (100) is upright. However, the container (100) may rest in alternative positions. The container (100) also comprises a main body (105) formed of the four major surfaces (501A), (501B), (501C), and (501D). Each of these surfaces (501A), (501B), (501C), and (501D) extends from their distal ends (503), which are attached to the base (101), to their proximal ends (507), which terminate at the top (107) of the container (100). The top (107) surrounds the neck (109) which is used to close the container and provides access into the internal volume (751) of the container (100).

The neck (109) is generally a conventionally designed neck (109) shaped as a generally hollow cylinder open at both ends. The proximal end of the neck (109) forms a rim (901). The distal end (907) connects to the top (107) of the container (100) at a shoulder (909). The neck (109) will generally also include a molded structure (911) designed for attachment to a lid (951). In the depicted embodiment, the attachment structure (911) comprises a helical screw thread arranged on the exterior surface of the main body (919) of the neck. This structure (911) allows for a lid (951) comprising hollow cylindrical side walls (953) and a closed top (955) with a mating attachment structure (961) located on the interior surface thereof, to be attached to the neck (109) by screwing.

In alternative embodiments of the neck (109), the shape and attachment structures (911) may alternatively be designed for use with a different lid (951). In some exemplary alternatives, the attachment structures (911) could comprise a helical screw thread arranged on the inside surface, or could comprise a single circumferential external flange (which may or may not be complete) for attachment of a snap-top type lid. Depending on embodiment, the lid (951) could also include safety features such as break away rings or tear off strips that are broken or are removed when the container (100) is opened after being initially sealed. The neck (109) also need not be cylindrical, but can be other elongated hollow structures in alternative embodiments.

The main body (105) of the container (100) comprises four major surfaces (501A), (501B), (501C), and (501D) resulting in the container (100) having a generally rectangular or square cross sectional shape. The cross section, however, in the depicted embodiment is more specifically hexagonal as each of the corners of the square (where the four major surfaces (501A), (501B), (501C), and (501D) would normally connect) have been replaced with four angled minor surfaces (511A), (511B), (511C), and (511D). Each minor surface (511) is generally positioned between two major surfaces (501) and vice versa.

It should be apparent that the main body (105) will generally appear the same from any of the four directions (viewed perpendicular to the major surfaces as shown in FIG. 1) so that the container (100) is symmetrical from its four sides. Thus, the container (100) can generally be considered a "square" container because it has four essentially identical sides. This design provides for a number of benefits in its use as packaging since the container (100) can be labeled on any major surface without regards for rotation. Generally, the container (100) will not be thought of as having a front, rear, or side faces until labeled as the label will often serve as the sole indication of the expected positioning of the container (100). In the discussion herein, square containers are generally preferred as they provide for improved "squaring" of the pallet as discussed later. However, it is by no means required that containers (100) designed for improved stacking be square and containers (100) which are rectangular, round, or any other form of container as known to those of ordinary skill can include the structures for stacking discussed herein.

The major (501) and minor (511) surfaces connect at their proximal ends (507) and (517) to the top (107) of the container (100). The top (107) generally extends from the neck (109) and is loosely horizontal. However, as opposed to traditional containers which will often utilize a flat, downward smoothly sloping, or combination of these elements top (107), the top (107) of the container (100) of FIGS. 1-4 comprises what is referred to herein as an undulating surface. The undulating surface generally provides a surface that changes position vertically if one was to trace a line at a fixed radius from the vertical axis (1001) of the container. Specifically, in this analysis, one would generally trace a smoothly undulating line or a waveform from the surface.

As can be best seen in FIG. 1, in the depicted embodiment, the undulation is arranged so that each facing (501) of the container (100) includes a similar portion of the form making all sides essentially identical when viewed directly. Thus, while FIG. 1 depicts the facing of major surface (501B), the same view of the other three major surfaces (501A), (501C), and (501D) would appear identical. In the depicted embodiment, the undulation is positioned so that the crests (521) occur at essentially the center of each of the major faces (501), and the troughs (531) will generally correspond to the center of each of the minor faces (511). This serves to give the container (100), when viewed perpendicular to a major face (501), a generally triangular upper surface appearance.

It should be noted that while this undulation is described as having a regular or smooth shape, it is not required that the resultant wave be regular, smooth, or of particular form. Instead, the elements of the present case provide that in the undulating arrangement the crest (521) and troughs (531) simply correspond the same on all sides. This makes each side essentially identical when viewed in planar view. Further, while it is preferred that a crest (521) be arranged at the center of a major face (501) and a trough (531) at the center of a minor one (511), this is by no means required and alternative patterns can be used including reversing this pattern (troughs (531) centered on major surfaces (501) and crests (521) on minor faces (511)), providing additional crests or troughs, or offsetting crests and/or troughs from the center points of faces. Similarly, if the container (100) has a different number of sides, crests and troughs may be rearranged to provide a repeating pattern based on the number of sides present.

Connection of the top (107) to the main body (105) will generally be at a slight slope rounding convexly outward from the interior (751) of the container (100) so that a plane drawn through the shoulder (909) (and/or distal end (907) of the neck (109)) would extend above both the troughs (531) and crests (521) of the top (107), specifically extending above most or all surfaces of the top (107). However, that arrangement, while depicted, is not required.

As should be visible from FIG. 1, because of the undulation and the slight slope or curve of the top (107), the top (107) will generally be considered to have four "depressions" (one at each trough (531)) and four ridges (one at each crest (521)). Further, the top (107) will generally have a slightly pyramidal arrangement when moving from the major surface (501) proximal end toward the neck (109). It should also be noted that while the top (107) has been discussed as having a smoothly undulating face, this is not required and the undulation may be more linear replicating triangular or even square "waves" resulting in a much more angled surface.

Generally, connection of the top (107) to the main body (105) will be through a smooth rounded connection surface (157) which serves to connect the two pieces in a smooth fashion. The curve will again generally be convex to the interior volume of the container (751), or, to put it another way, the axis about which the curve is rotated is within the volume of the container (751). Again, this is not required and a more linear construction, or a concave curving arrangement may be used in alternative embodiments. However, a rounded form is generally preferred as it allows for containers (100) to more easily stack without catching, as discussed later, and provides for ease in molding.

Figure 3:
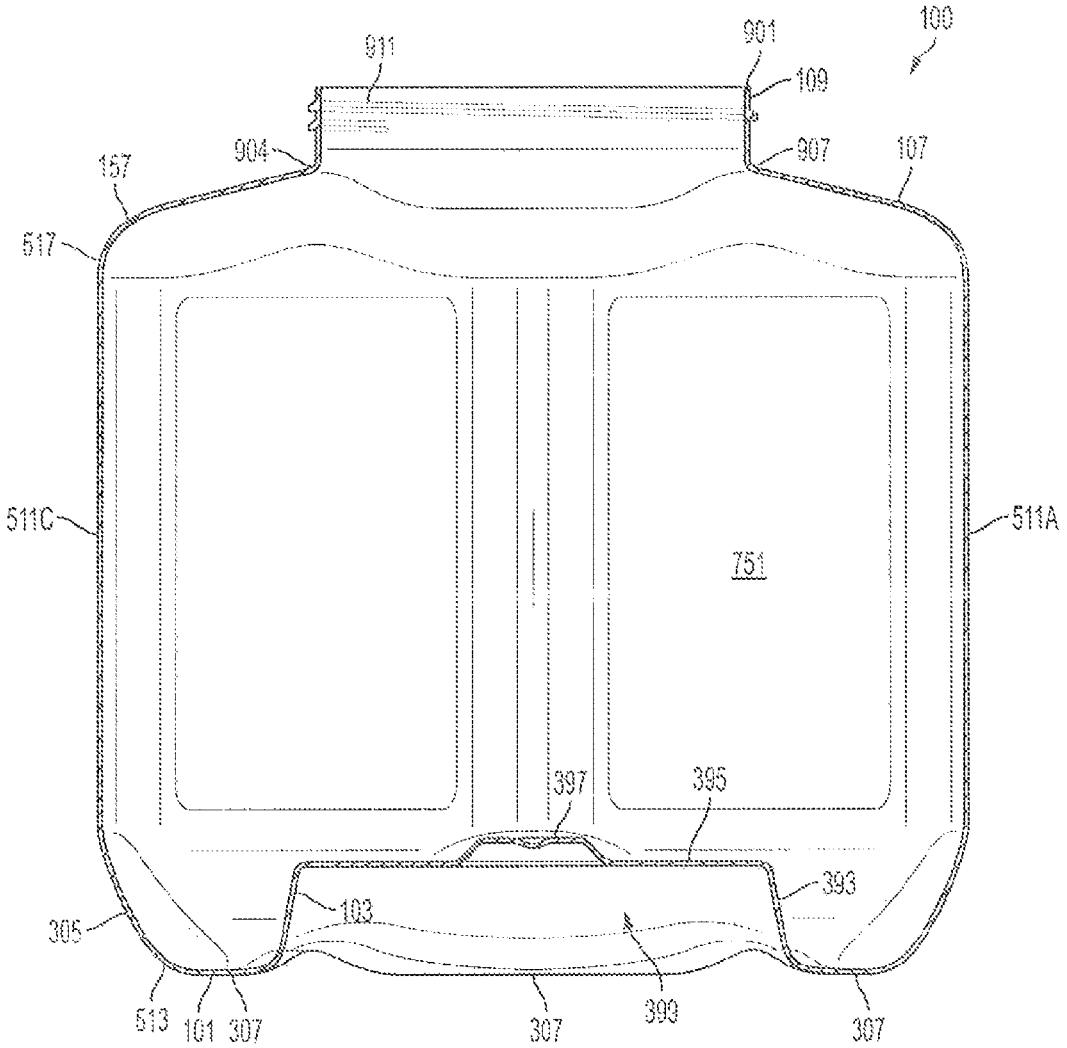
FIG. 3 provides a cross-sectional view of FIG. 2 along the line 3-3.
Figure 4:
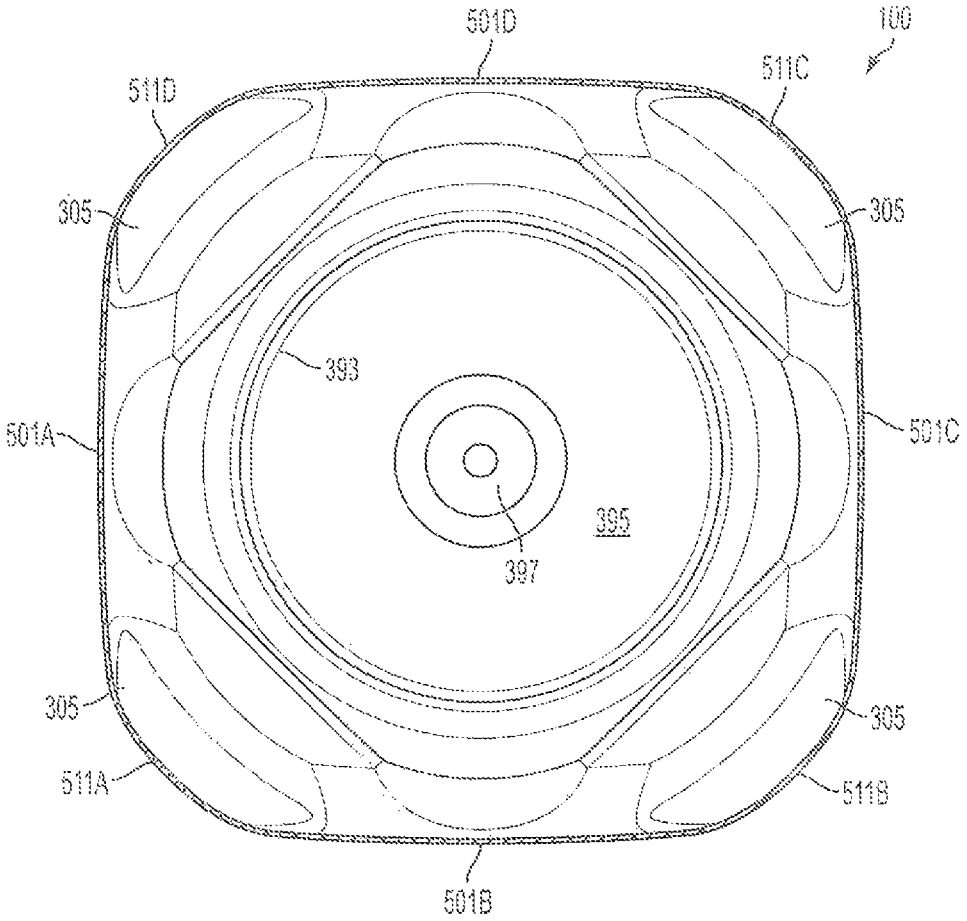
FIG. 4 provides a cross sectional view of FIG. 1 along the line 4-4.

At the distal end (503) of the main body (105), the major panels (501) will generally connect to the base (101) in the same smoothly curving fashion (albeit in the opposing direction) as they connected to the top (107). The minor faces (511) may also connect at their distal ends (513) in a similar fashion. However, in the depicted embodiment, they instead include an angled section (305) bending inward prior to the point of connection as best shown in FIG. 3.

The base (101), like the top (107), will generally also be formed of an undulating surface. However, in order for the container (100) to stably sit on a flat surface, the undulation may be slightly more confined. Specifically, the base (101) will often include four flat sections or feet (307) with one positioned at each corner. There is then a smooth upward curve (309) from the edges of the feet (307) leading to a crest (319) centered on each of the major surfaces (501).

The undulation of the base (101) is designed to provide for a base (101) serving two purposes. In the first instance, the flat portions (307) or "feet" are designed to allow the container to sit on a flat horizontal surface and to provide for sufficient friction to provide a stable design. Therefore, it is generally desired that they are at the corners as this gives the container (100) a wide "stance" and improved stability. At the same time, the curve (309) is designed to be similar in shape and position to the curve (529) on the top (107) so as to interact with it, as discussed below. To put this another way, the base (101) and top (107) are complimentary and designed to interact by specifically touching as discussed herein.

The center of the base (101) includes a recessed portion (103) which in the depicted embodiment comprises a cylinder having walls (393) and its upper end closed by a generally horizontal cap (395). The cap (395) also includes a further depression (397) which comprises a second recessed portion into the volume (751) of the container (100). The walls (393) will generally connect in a smoothly curving fashion to the base (101) generally by curves which curve smoothly outward in a convex fashion from the interior (751) of the container (100) into the hollow interior (399) of the recessed portion (103). The cap (395) will also generally connect to the walls (393) in a smooth fashion, however, this is likely to involve a tighter concave curve providing the inside with a sharper edge.

The recessed portion (103) will generally have a diameter which is slightly larger than the diameter of the neck (109). Specifically, the diameter of the recessed portion (103) will generally be close to, but still slightly larger to the external diameter of the lid (951) as can be best seen in FIG. 6. The height of the walls (393) will generally be similar, but slightly larger than the height of the neck (109). Specifically, the recessed portion (103) will generally have a height generally equal to the height of the neck (109) and lid (901) combination when the lid is placed on the neck in the standard fashion. This is also best seen in FIG. 6.

Figure 5:
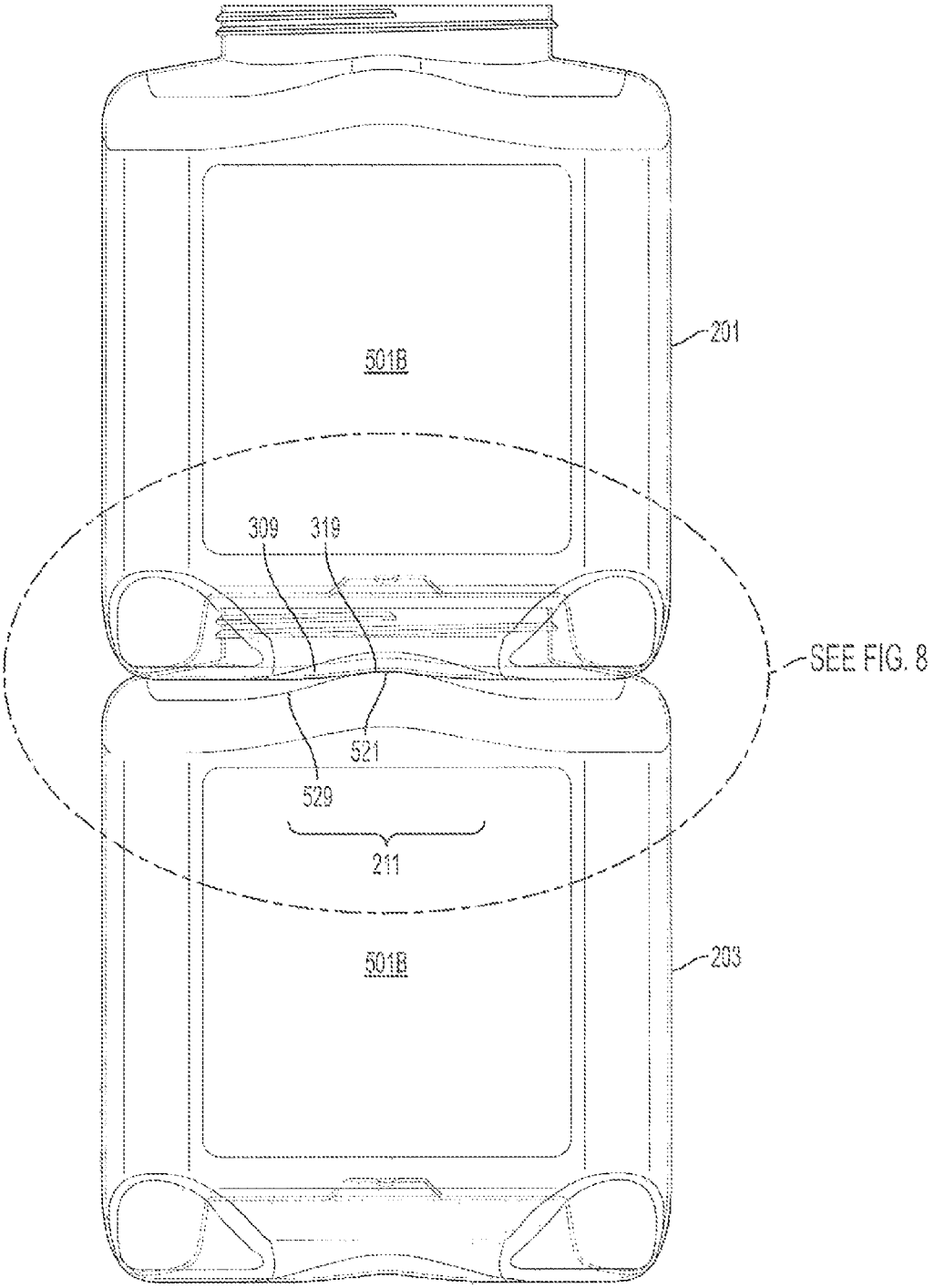
FIG. 5 provides a view of two similar containers stacked on top of each other. Both containers in this depiction are shown as formed of translucent material to make internal structure visible.

There are a number of design relationships between the top (107) and the base (101) and between the neck (109) and recessed portion (103) which provide for benefits to the container (100). Specifically, the components are arranged to allow, as shown in FIG. 5, for a first container (201) to be placed on top of a second container (203) in a nesting fashion. Specifically, the first container (201) will not rest solely on the rim (901) of the lower container. Instead, the first container (201) will rest on at least a portion of the top (107) in addition to or instead of on the closed top of the lid (955) (if it is present).

Figure 6:
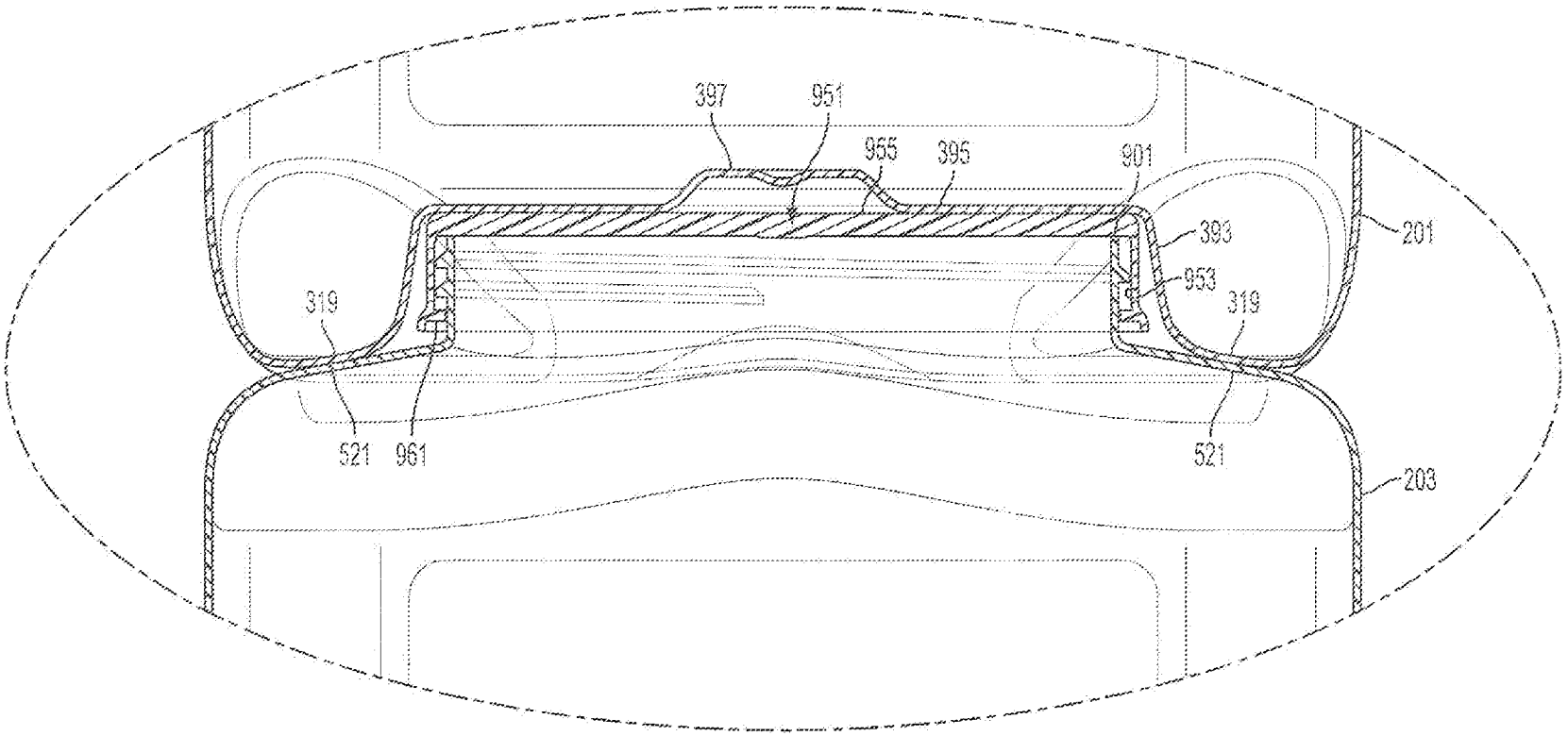
FIG. 6 provides a detail cross sectional view of the neck and recessed portion of the interaction between two stacked containers which have lids placed thereon. The containers in this depiction are shown as formed of translucent material to make internal structure visible FIG. 7 provides a detail planar view of the contact surfaces when viewed perpendicular to a minor surface. The containers in this depiction are shown as formed of translucent material to make internal structure visible.

In FIG. 5 the lower container (203) is shown resting on a horizontal surface. An upper container (which is of identical design) is then placed thereon. As should be apparent, the various components of the containers interact in a specific way. In the first instance, the neck (109) of the lower container (203) is designed to be positioned within the recessed portion (103) of the upper container (201). The arrangement, in cross-sectional detail, is shown in FIG. 6. As can be seen in FIG. 6, when the lid (951) is in place, the upper container (201) rests on the lower container along the closed top (955) of the lid (951) and also the crest (319) of the base (101) of the upper container (201) is in contact with the crest (521) of the top (107) of the lower container (203). In the event that the lid (951) is not in place, it should be apparent from FIG. 6 that the rim (901) would not contact the cap (395) but the two crests (319) and (321) would still be in contact.

Figure 7:
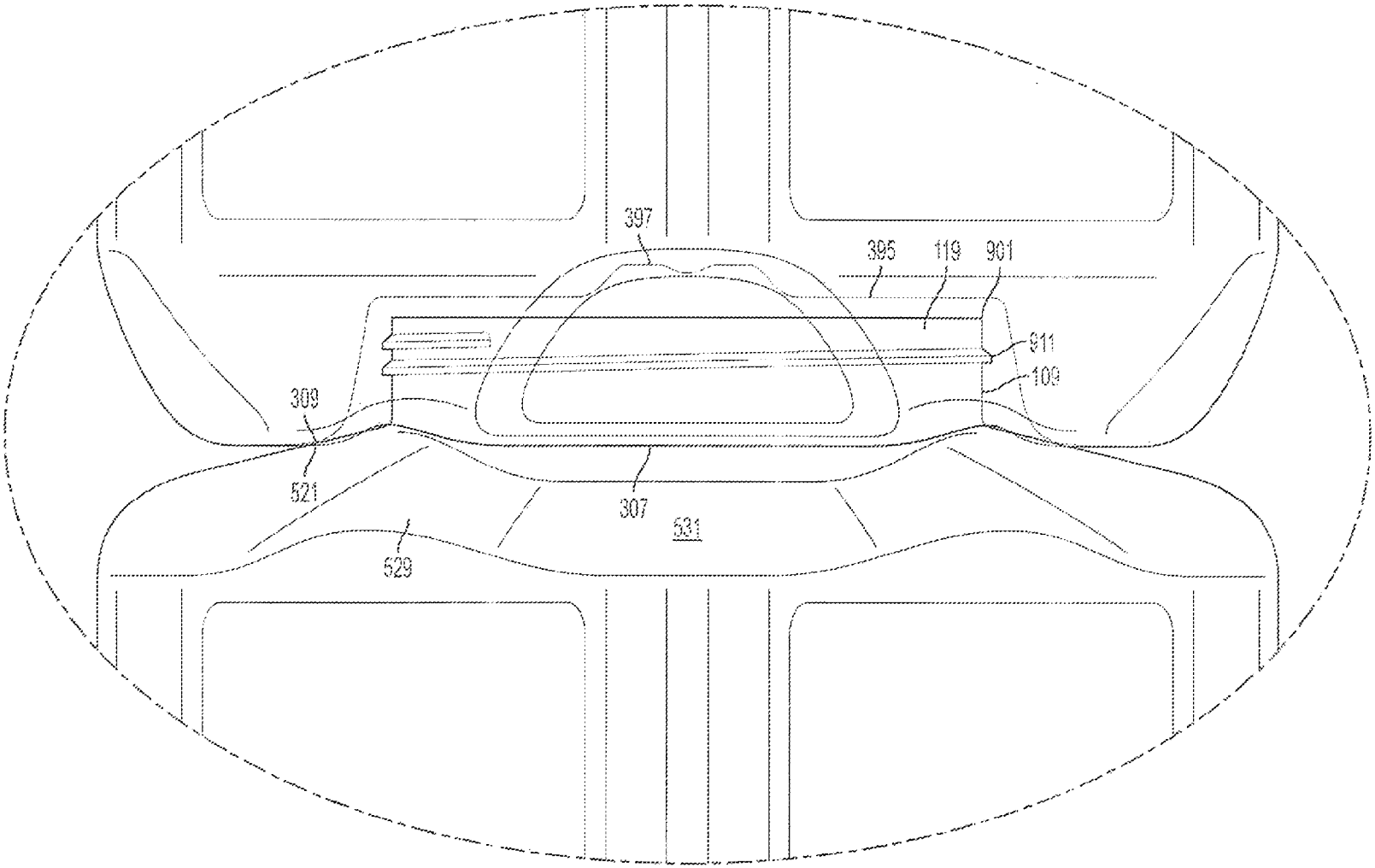

It should also be apparent from FIG. 7 that the crests (319) and (321) do not connect solely at their uppermost radial line, but that a region (211) of connection exists where the undulation of the base (101) and top (107) match. As each of the containers (201) and (203) is of generally identical design, it should be apparent that this correspondence is not only true across containers, but that the undulation correspondence is true within a single container.

In an embodiment, the connection between the upper (201) and lower (203) container will actually continue around a ring of contact surrounding the shoulder. However, in the depicted embodiment, because the feet (307) are flat, the ring is in fact discontinuous. Specifically, as can be best seen in FIGS. 7 and 8, the flat portion (307) will extend from the edge of the contact portion (211) generally linearly above the surface (533) leading to the trough (531), the trough (531) itself, and the surface (535) leading from the trough to the contact portion on the next around major surface (501).

Figure 8:
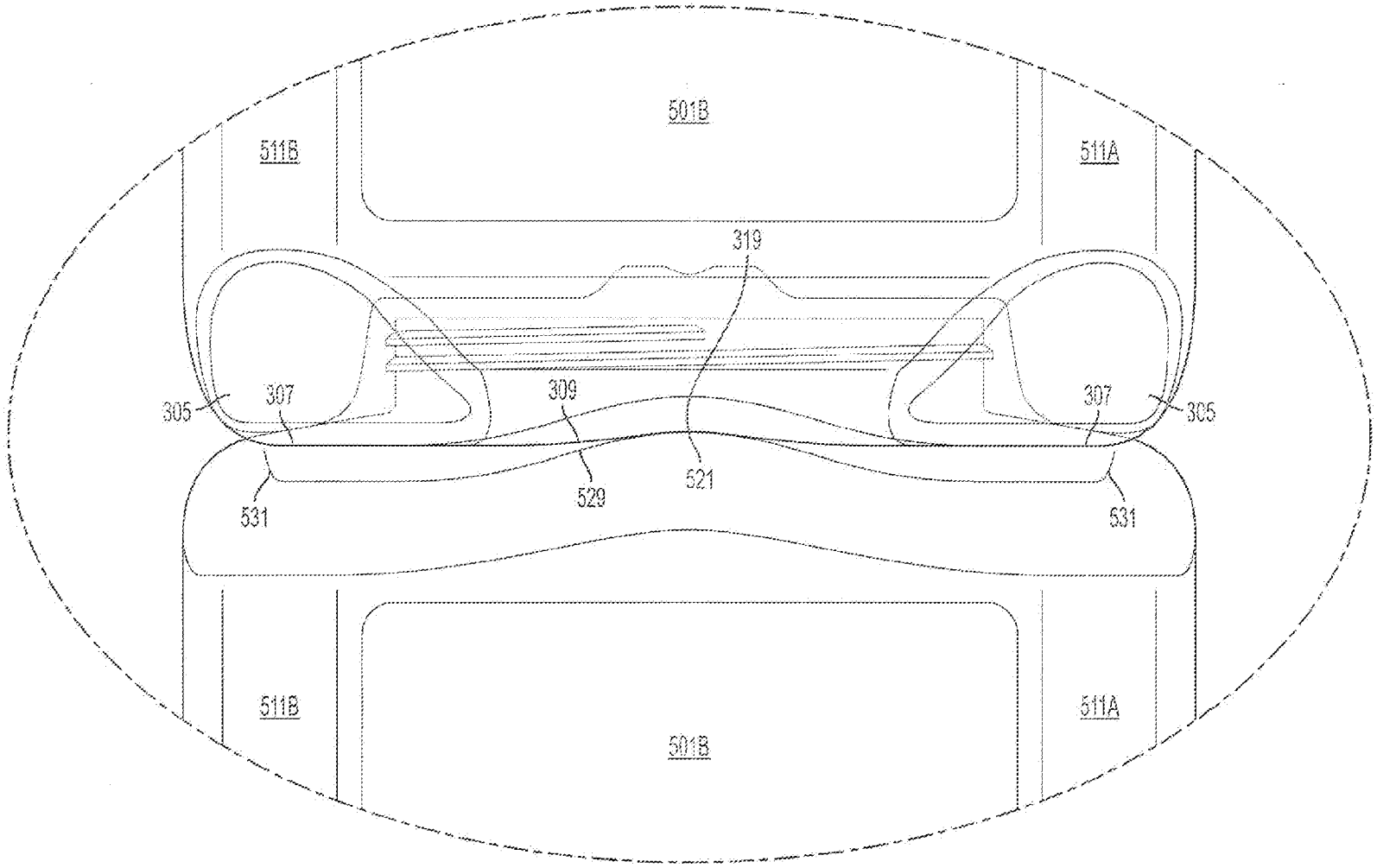
FIG. 8 provides a detail planar view of the contact surfaces when viewed perpendicular to a major surface. The containers in this depiction are shown as formed of translucent material to make internal structure visible.

As should be apparent from FIGS. 7 and 8, there is, thus, an area of connection between the top (107) of the lower container (203) and the base (101) of the upper container (201) at each of the major surfaces. Thus, the containers (201) and (203) of FIG. 5 form four discrete contacting surfaces which are arranged generally symmetrically about the containers (201) and (203).

These multiple areas of contact will generally provide for a couple of benefits with regards to the container (203). In the first instance, because the contact is spread across a relatively large surface area of the top (107) (when compared to the surface area of the rim (901)), the weight of the upper container (201) is generally distributed across a greater surface area of the lower container (203) to assist with support. The weight is also generally more focused via this distribution at the crest of the waveform of the top in the center of each of the major faces (501) and across a surface of not insubstantial area.

As should also be apparent, as the crest (521) of the undulation presents the major face with a generally triangular upper surface, this crest (521) is quite strong and resists forces applied against it in a fashion well understood by those of ordinary skill. Thus, the undulation crest (521), in combination with the rigidity of the major faces (501), will serve to provide enhanced resistance to deformation ("crush resistance") from the force of the container (201) placed on top because the shape of the connection, and the shape of the supporting face, are shapes well known to those of ordinary skill to resist deformation.

While the benefits of the crush resistance could be obtained even if the base (101) did not have a corresponding undulation at the crest (521), the inclusion of the corresponding undulation provides for other benefits. In particular, the interaction of the base (101) and top (107) of stacked containers (201) and (203) provides for resistance to rotational motion of the two containers (203) and (201) relative to each other. Specifically, the containers (201) and (203) generally cannot rotate relative to each other about the central axis (1001) without some vertical movement when they are positioned so that the major faces (501) are generally co-planar. Specifically, the foot (307) of the upper container (201) would need to ride over the crest (521) of the lower container (203) and that requires the two containers (201) and (203) to separate in the vertical (along the axis (1001)) direction.

This separation would generally be gradual, due to the sloping sides away from the corresponding high points and need not be a large percentage of distance relative to the container size or even a relatively large absolute distance. Any such rotation can be easily inhibited by providing sufficient force to the base (101) of container (203) and the top of container (201) to inhibit them from being able translate vertically even a relatively small amount.

The interaction not only inhibits rotation, but can also result in a self centering effect. In particular, because the lowest energy resting state is generally where the base (103) of container (201) and top (107) of container (203) are aligned, the containers (201) and (203) will generally try to align themselves in that arrangement (both from vertical position and from horizontal rotation), particularly if exposed to vibration or other small movement. Thus, the containers (201) and (203) obtain a nesting arrangement where the top (107) of container (203) nests into the base (101) of container (201) above it when containers (201) and (203) are stacked. Further, the containers (201) and (203) will generally want to align with their major faces (501) being generally co-planar.

As can be seen in FIGS. 5 and 6, the design of the container (100) allows for stacking of empty containers in a manner that was not previously done. Specifically, the upper container (201) is not entirely supported by the rim (901) of the neck (109) of the lower one (203). Instead, the rim (901) is supporting no weight at all, the entire weight of the above container (201) is instead supported on the top (107) of the lower container (203) at the plurality of intersection points which are in turn supported by shoulder and major surfaces of that container (203).

As is shown in FIGS. 5 and 6, when the containers (203) and (201) are full, the upper container (201) will generally rest on the same surfaces of the top (107) as when they were empty. However, as is best seen in FIG. 6, in an embodiment, the inclusion of a lid (951) can actually allow the cap (395) of the recessed portion (103) to be placed in contact with the lid (951). This allows for an even greater surface of connection between the adjacent containers (201) and (203) and will generally allow for a lower container (203) to resist deformation due to an increased force from the greater weight. This additional surface contact is desirable, but not required. Generally, containers (100) will only have their lids (951) in place when they are full and when they have been filled, the containers (100) are generally heavier. Thus, in such an embodiment, containers (100) which are empty (where the upper containers (201) are lighter) have a reduced contact surface, while filled containers (100) have an increased contact surface, providing increased force distribution.

This ability to stack provides for a number of benefits in the ability to transport an increased number of containers (100) in a reduced space. In the first instance, the improved surface area of connection can provide for stacking to a greater total height as the likelihood of a lower container (203) being damaged due to the overhead weight of additional containers is reduced, even when compared to situations where segregating sheets are used between stacked layers to reduce force.

Further, because the containers (100) "nest" when they are stacked, it is also possible to eliminate the need for segregation sheets or other components between layers and to eliminate the wasted space around the neck (109) of a lower container (203). This actually reduces the total height of a stack of similarly sized containers (100) and allows for the same number of containers (100) to take less space, or for an increased number of containers (100) to be placed in the same space. Effectively, the container stack has moved volume defined by the stack but not within the containers, into the volume inside the containers, where it is no longer wasted. This increases transportation and storage efficiency.

The idea of having the containers (100) take up wasted space when being transported or stored is not limited to just this nesting stacking methodology. It would be understood by one of ordinary skill in the art that containers, when shipped, are usually shipped in a fashion that specifically requires them to conform to certain size requirements.

It is well established that containers (100) (both empty and full) are generally shipped on pallets (801) so as to provide for easy loading, moving, and storing by forklift trucks and related apparatus, and are generally only stacked to a height that is designed to fit inside a truck cargo container or a standard warehouse storage rack. Placing containers (100) in arrangements which are significantly smaller than these tends to result in significant wasted space as these type of storage and transportation tools are relatively ubiquitous. Further, placing the containers (100) in arrangements that are larger than these often results in them not fitting into standard transport or storage systems. It should be apparent, however, that wasted space from packing the containers (100) too small is far easier to deal with than packing them too large. For this reason, it can be very difficult to totally eliminate the transport and storage of empty space.

The dimensions of pallets, truck boxes, and other location and devices used with containers are generally well known and relatively fixed (at least within certain supply chains). While pallets come in a variety of standard sizes, within an industry, sizes are often generally fairly standard and are commonly universally sized within a particular business.

Figure 9:
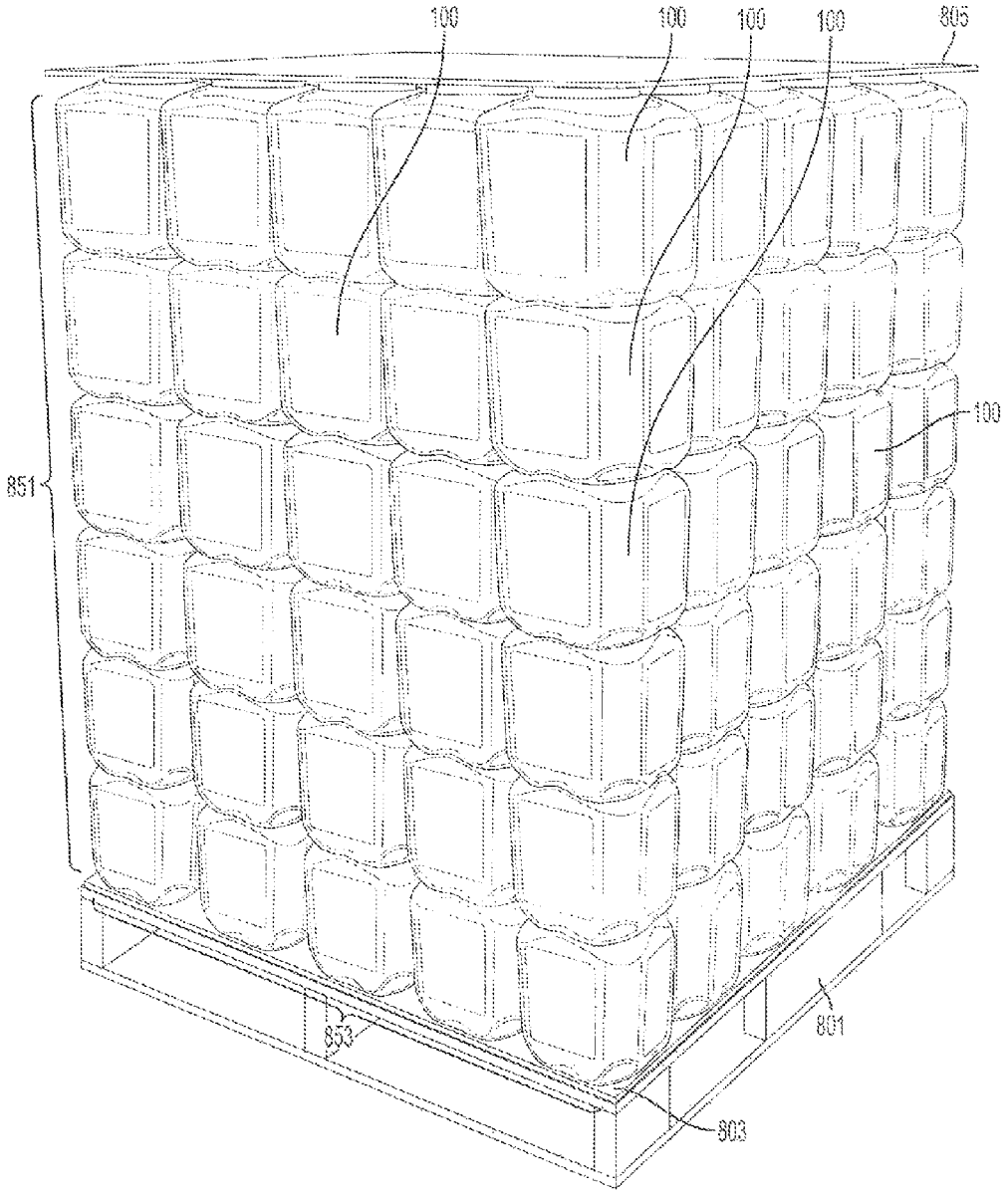
FIG. 9 shows a plurality of empty containers of FIG. 1 arranged in stacks on a pallet as they would be for transport. The containers in this depiction are shown as formed of opaque material to better show interrelationships.

In an embodiment, the present container (100) serves not only to internalize vertical space, but to "square out" the space within the parallelepiped volume defined at its base by the pallet (801) onto which containers are placed. The term "square out" is basically used to refer to the attempt to avoid wasted space both within a vertical stack of container layers and within each layer of containers. FIG. 9 provides for a plurality of containers that have been palletized for shipping.

To help clarify terminology, as can be seen in FIG. 9 there is a pallet (801) onto which is placed a slip sheet (803), the slip sheet (803) has placed thereon 150 containers (100). The containers are arranged in 25 vertical stacks (851) with six containers each. The 25 stacks are arranged on the generally square pallet in a 5 by 5 arrangement. Thus, while there are 25 stacks (851), there are also 6 layers (853) of containers (100), each of which includes 25 containers arranged at the same level of height. E.g. the first level of containers (100) all rest on the slip sheet (803) and each of the first level containers (100) have 5 containers (100) stacked on them. All containers (100) at the same vertical height are in the same layer (853). At the top of the stacks is another slip sheet (805). There may also be bands or other objects (not shown) wrapping over the slip sheet (805) and through the pallet (801) to prevent upward movement of the stacks (851) relative to the pallet (801).

While the pallet of FIG. 9 includes slip sheets (803) and (805) to assist with securing the containers (100) to the pallet (801) and making it easier to remove them from the pallet (801) without damage, in alternative embodiments slip sheets (803) and (805) need not be used. They are shown in the embodiment of FIG. 9 because slip sheets (803) and (805) generally are preferred when palletizing smaller containers (100) to prevent the stacks (851) from being unstable due to their being spaces between the floorboards of the pallet (801) and to provide for a flat upper surface to allow another pallet (801) to be stacked on top of the first with less risk of catching and to better secure tie down straps and similar objects to the pallet (801).

The present containers (100) as shown in FIG. 9 have been sized and shaped to square out the pallet (801) as much as possible. Specifically, as the containers (100) themselves are generally square, it is logical that the arrangement of stacks (851) would be the same (in this case 5 stacks (851)) in both dimensions. This provides that the major surfaces for adjacent containers (100) can be touching to limit the amount of empty space between adjacent containers (100) within any given level (853). Further, as the present containers (100) can stack directly on top of each other due to the nesting arrangement discussed above, certain levels do not have fewer containers (100) in order to different distribute force to lower levels and there is no need to alternate containers (100) within a horizontal line in either direction. To put this another way, the containers (100) are arranged linearly both horizontally and vertically. Similarly, there is no need to use divider sheets between the layers (853).

It should also be recognized that the containers (100) of FIG. 9 are also sized in each of their two horizontal dimensions to generally be a fixed subdivision of the length of the side of the pallet (801) used to transport them. Specifically, as the pallets (801) are generally of fixed size and are square, the cross section of the container (100) (when cut by a horizontal plane), is also preferably generally square. In this way, the container (100) does not have to be rotated a particular direction in order to make sure it is "aligned" with the pallet (801) and the container stacks (851), when placed in a touching or very close proximity, have a footprint very close to that of the pallet (801) itself.

As should be apparent, by making the square dimension of the container (100) a fixed subdivision of the pallet (801) size, the containers will generally take up almost the entire surface area of the pallet (801). Thus, there is little to no wasted horizontal space on the pallet (801). Further, when pallets (801) are placed next to each other, the faces (501) of the containers (100) on one pallet (801) which are adjacent to the faces (501) of containers (100) on the adjacent pallet (801) can be in close proximity. They can touch in a perfect arrangement. However, it is generally not possible for operators of fork trucks and related devices to place the container pallets (801) with sufficient precision to completely eliminate gaps between them and pallets (801) are rarely perfectly sized to fit in a truck or storage solution, so this ideal arrangement is rarely obtainable in practice. By squaring out pallets (801), however, the space is generally maximized to the extent possible.

It is further desired that with vertical height, the combination of horizontal base size and vertical height be selected so as to allow for a standard height (which may be a fixed division of the height of a truck cargo box for example) to be obtained. At the same time, in order to make containers of a generally desirable size, in the event that obtaining all three dimensions in the desired ratio is not possible, the height is generally the first to be sacrificed for more pressing needs as it is the area where excess space is generally the most useful for purposes of stacking and storing, and the area where there is the most variance between applications.

One of ordinary skill, however, should see that it may be possible to actually maximize ratios by altering not just the dimensions of the container (100) main panels (501), but also by altering other dimensions, such as the diameter of the rim (109), the positioning and size of the minor panels (503), and related objects. In this way, a relative squaring out of the palletized containers can be obtained.

FIG. 5 also shows another benefit of the containers (100) when in the palletized arrangement. Because of the nesting arrangement of the containers (100), it is generally not possible for a container stack (851) to slip so long as it is held by pressure from the vertical ends. As discussed above, rotation of the containers (100) relative to each other is unlikely due to their design. It is, therefore, quite difficult for a shock to the pallet arrangement to cause rotation and deformation within the stacks (851) formed thereon so long as there is vertical strapping or similar materials inhibiting the stacks (851) from moving vertically relative to each other and, in some cases, the pallet (801). Still further, because the neck (109) of one container (100) is within the recessed portion of another, a container (100) is generally very difficult to knock out of its stack (851) via a horizontally applied force. Thus, the stacks (851) and pallet (801), when tied together, form a relatively rigid structure which will generally resist coming apart until it is purposefully deconstructed.

As can also be seen from FIG. 9, the palletized containers (900) will generally require far fewer disposable components. Specifically, only the pallet (801), slip sheet (803), and cover sheet (805) are generally required. For a 150 container pallet, this can easily eliminate 5 segregation sheets completely. Further, strapping is generally only necessary in the vertical direction so any horizontal strapping that may have been previously required can also potentially be eliminated.

From review of FIG. 9, it is apparent that in another embodiment it is possible to eliminate the slip sheet (803) and cover sheet (805) and utilize only reusable pallet pieces. Specifically, the standard pallet (801) can be replaced by a specialized pallet of similar size and a specifically designed top panel. These two pieces would be designed to be rugged and repeatedly reusable but would comprise a pallet having a top surface area corresponding to the surface area that would be generated by the top and necks of a prior level of containers (100). Thus, this pallet surface would essentially allow for the various columns to nest on the pallet as if there were another level of containers (100) below, gaining all the benefits of that arrangement. A top can similarly be designed to simulate the combined bases of a level of containers (100) on its underside. In this situation, the disposable cardboard components of the shipping are completely eliminated and the transportation components are all repeatedly reusable resulting in a significant reduction in the amount of waste generated from transport. Further, this arrangement, because it now has the pallet and cover interact with the stacks in a similar nesting fashion, can provide further rigidity to the pallet arrangement when vertical strapping is applied resulting in an ability to actually reduce the number of straps needed and to further inhibit the containers (100) from becoming unbundled during transport resulting in a very rugged shipping arrangement.

While the above has discussed shipping of the containers (100) empty, one of ordinary skill would also recognize, that the container shape can also work when the containers (100) are full. As was discussed above in conjunction with FIGS. 5 and 6, the containers (100) can also be stacked after they are filled and with their lids in place. Thus, the container shape not only provides benefits to shipping empty containers to filling locations, but provides most, if not all, of the same benefits when shipping the filled containers (100) to end destinations.

It should be recognized that the containers (100) can be formed by any method known to one of ordinary skill including blow molding, injection molding, and other plastic molding techniques. It is preferred that the containers (100) utilize blow molding for their manufacture as most such containers (100) will be formed of PET and therefore blow molding is a preferred formation technique. However, it should be appreciated that the formation of the recessed portion (103) can be difficult in standard blow molding. Thus, modification to standard blow molding tools as well as the operation of a blow molding machine can be carried out to allow for the container (100) to be more easily blow molded.

The container (100) may be of any size or volume, however, the ratio of its three major dimensions will generally be dictated by its size in a fashion where the resulting horizontal dimensions are designed to maximize the available space on the pallet (801). Thus, the major horizontal dimensions will generally be dictated by the size of a standard pallet (801) or, if one is used, a specialized pallet designed to carry these types of containers. Specifically, those dimensions will be a subdivision of the surface area of the pallet (801) allowing a certain number of containers to be placed along each dimension.

As squaring out the container can have benefits, in some embodiments, it can be desirable to alter the size of the container slightly so that the container is actually slightly larger (in volume) than the volume of material which will occupy it. Thus a "gallon" container may actually have an internal volume slightly over 1 gallon recognizing that the container (100) will be filled with a predefined volume and will include some empty space if this provides for improved squaring out of the resultant container pallet.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A container configured to stack with a second container having generally the same configuration as said container comprising:

a base;

a top;

a main body extending generally vertically from a distal end connected to said base to a proximal end connected to said top, said main body comprising four generally planar major surfaces arranged to have a generally rectangular horizontal cross section;

a neck, said neck being positioned in said top to allow access into an internal volume of said container; and a recessed portion, said recessed portion being positioned in said base;

wherein each of said top and said base comprise corresponding undulating surfaces having a plurality of crests and troughs, said top and base being configured such that when said neck of said container is placed in said recessed portion of said second container, said plurality of said crests on said base of said second container are in contact with said plurality of crests on said top of said container, and said plurality of troughs on said base of said second container are not in contact with said plurality of troughs on said top of said container; and wherein said crests of said undulating surfaces are arranged generally in the center of said major surfaces on both said base and said top and said troughs of said undulating surfaces are arranged generally where said major surfaces connect to each other on both said base and said top.

2. The container of claim 1 wherein said neck is cylindrical having an outer surface and a top rim.

3. The container of claim 2 wherein said neck includes an external screw thread arranged to surround said neck.

4. The container of claim 3 wherein said recessed portion of said second container, when said plurality of said crests on said base of said second container are in contact with said plurality of crests on said top of said container, and said plurality of troughs on said base of said second container are not in contact with said plurality of troughs on said top of said container, does not contact said screw threads of said container.

5. The container of claim 3 wherein said recessed portion of said second container, when said plurality of said crests on said base of said second container are in contact with said plurality of crests on said top of said container, and said plurality of troughs on said base of said second container are not in contact with said plurality of troughs on said top of said container, does not contact said rim of said container.

6. The container of claim 1 further comprising four minor surfaces, each of said minor surfaces being connected to two of said major surfaces and each of said major surfaces being connected to two of said minor surfaces and said troughs of said undulating surfaces are arranged generally at the centers of said minor surfaces on both said base and said top.

7. The container of claim 6 wherein said troughs of said base are generally flat surfaces.

8. The container of claim 1 further comprising a lid placed on said neck of said container.

9. The container of claim 8 wherein said recessed portion of said second container, when said crests of said container and said second container are in contact, contacts a top of said lid.

10. A pallet of containers comprising:

a plurality of containers, each of said containers comprising:

a base;

a top;

a main body extending generally vertically from a distal end connected to said base to a proximal end connected to said top, said main body comprising four generally planar major surfaces arranged in a generally rectangular horizontal cross section;

a neck, said neck being positioned in said top to allow access into an internal volume of said container; and a recessed portion, said recessed portion being positioned in said base;

wherein each of said top and said base comprise corresponding undulating surfaces having a plurality of crests and troughs, said top and base being configured such that when said neck of a first container is placed in said recessed portion of a second container, said plurality of said crests on said base of said second container are in contact with said plurality of crests on said top of said first container, and said plurality of troughs on said base of said second container are not in contact with said plurality of troughs on said top of said first container; and wherein said crests of said undulating surfaces are arranged generally in the center of said major surfaces on both said base and said top and said troughs of said undulating surfaces are arranged generally where said major surfaces connect to each other on both said base and said top;

a pallet having a surface area; and a cover sheet;

wherein said plurality of containers are arranged in a plurality of stacks, each of said stacks including at least two of said containers;

wherein said stacks are positioned on said surface area; and wherein said cover sheet is positioned on said stacks.

11. The pallet of claim 10 wherein said stacks are positioned above substantially all of said surface area.

* * * * *